United States Patent [19]

Pawlicki et al.

[11] Patent Number: 4,565,371

[45] Date of Patent: Jan. 21, 1986

[54] RACKET HAVING A HANDLE WITH DIFFERENT STRIKING CHARACTERISTICS ON OPPOSITE SIDES

[76] Inventors: Ulrich Pawlicki, Im Schellental 8; Wolfgang Schüler, An der Kopfbuche 20, both of D-5024 Pulheim, Fed. Rep. of Germany

[21] Appl. No.: 594,535

[22] Filed: Mar. 29, 1984

[30] Foreign Application Priority Data

Apr. 9, 1983 [DE] Fed. Rep. of Germany ..... 3312834

[51] Int. Cl.[4] ..... A63B 49/08

[52] U.S. Cl. ..... 273/73 J; 273/73 F

[58] Field of Search ..... 273/73 F, 73 J, 75, 273/80 B, 67 R, 67 A, 67 DA

[56] References Cited

U.S. PATENT DOCUMENTS 4,070,019 1/1978 Segal et al. ..... 273/73 F 4,326,714 4/1982 Novack ..... 273/73 F X

FOREIGN PATENT DOCUMENTS 23826 8/1935 Australia ..... 273/73 F

*Primary Examiner*—Richard C. Pinkham

*Assistant Examiner*—Matthew L. Schneider

*Attorney, Agent, or Firm*—Spensley, Horn, Jubas & Lubitz

[57] ABSTRACT

A tennis racket having a handle which is constructed so that the racket will flex more readily when the ball strikes one surface of the racket strings than when the ball strikes the opposite surface of the strings. This difference in flexibility enables the racket user to selectively return a soft or a hard stroke by turning the racket through 180°. The difference in handle flexibility can be obtained by (1) making the handle assymetric in cross section as in FIG. 1, or (2) making one longitudinal side of the handle of a material of different elasticity than the opposite longitudinal side, or (3) providing a bend in the handle as shown in FIG. 3 and FIG. 4.

1 Claim, 4 Drawing Figures

FIG.1
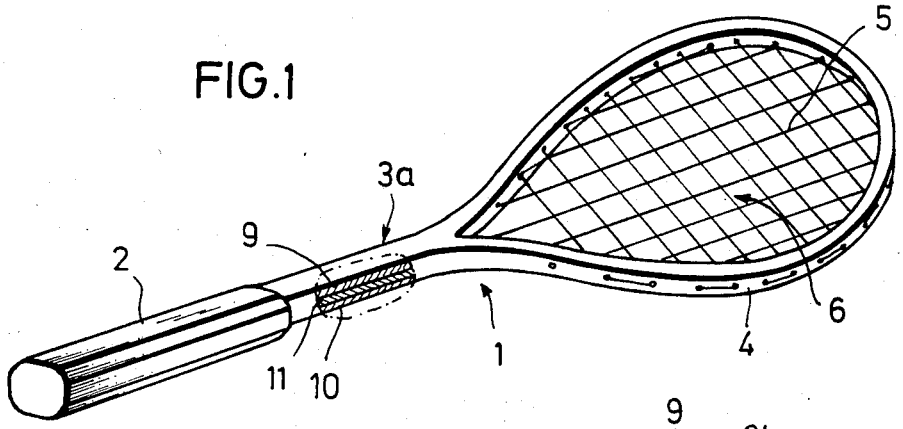
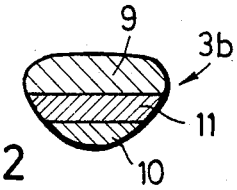
FIG.2
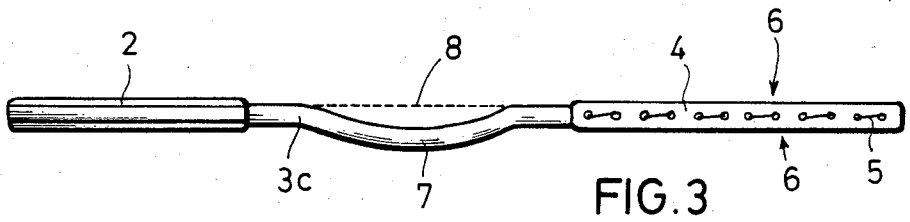
FIG.3
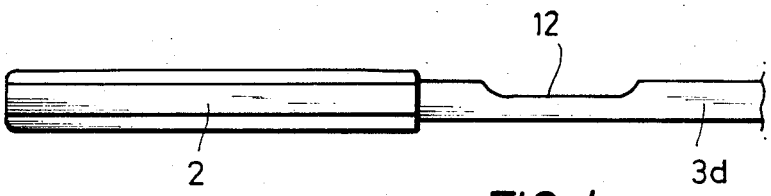
FIG.4

RACKET HAVING A HANDLE WITH DIFFERENT STRIKING CHARACTERISTICS ON OPPOSITE SIDES

BACKGROUND OF THE INVENTION

The invention relates to a game racket, in particular to a tennis racket comprising a hand grip portion, a handle and a head carrying strings which form a bilateral striking area.

In the known game racket, the head and the handle are made of wood, plastics or metal and of different combinations of said materials including different laminates. Subject to the material composition, different elastic properties of the game racket are realised in cooperation with the elastic properties of the strings. With a relatively inflexible game racket, in particular a tennis racket, a so-called "hard" stroke with a high ball velocity is obtained by a corresponding striking force. On the other hand, relatively flexible tennis rackets permit to catch and return much better "hard" strokes or shots at high ball velocities of the opponent. With a less flexible tennis racket, the arm is exposed to high shocks in case of exchanges of "hard" strokes which may result in an inflammation of the muscles generally known by the name of a "tennis arm".

It is an object of the invention to provide a game racket, in particular a tennis racket of the type mentioned above which allows to perform "hard" and "soft" strokes.

SUMMARY OF THE INVENTION

To solve said problem, the invention provides a handle which, transversely to the striking area has a higher flexibility or elasticity from the one side than from the other side.

A tennis ball may be struck by both sides of the striking area of the racket. Subject to the position taken by the tennis ball to be struck in relation to the player, there is made a difference between a forehand and a backhand stroke which, unless the racket is twisted during the game, will always hit the same striking area side.

By means of the tennis racket of the invention, it is advantageously possible to perform e.g. a forehand stroke by always using the "harder" side of the racket, while the backhand stroke is realised always by the "softer" side. This normally meets with the striking skill of the player who usually is a better forehand than backhand player. With a softer striking quality by the normally weaker backhand, it is possible accordingly to easily return "hard strokes" of the opponent on the own backhand.

On the other hand, by simply and quickly turning the racket through 180°, the striking property of the tennis racket can be altered in regard to the forehand or backhand. Thus, it is possible to quickly adapt oneself—even during the exchange of balls—to the playing style of the opponent and to catch a "hard" stroke in using the "soft" striking properties of one's own racket and vice versa. Thus, the playing possibilities in offensive or defensive matches are considerably enlarged for a tennis player. For inst. a "hard" tennis racket which could be exchanged at best hitherto at the end of a match against a "softer" one by interfering in a complicated manner with the flux of the event, will be now always available to be used surprizingly also accordingly.

Due to the invention, players who are endangered for a tennis arm inflammation need not renounce on a "hard" tennis racket for an occasionally "hard" stroke in the course of the match.

At both sides of its central sectional plane parallel to the transverse axis of the striking area, the racket handle may substantially consist of materials having different elasticity properties. Moreover, the cross sectional shape of the handle may be different at both sides of said sectional plane.

Due to an asymmetric design of the handle concerning the construction and/or the material composition, in relation to a central sectional plane parallel to the transverse axis of the striking area, the transmission of the striking action on the hand grip portion is varying subject to the used side of the striking area.

The handle may be of a straight-lined design with the elasticity properties resulting either from the use of different materials, from its cross sectional shape or both and involving the advantage that it does not look different from a conventional tennis racket, although it really displays the favorable properties of the invention.

In a preferred embodiment of the invention, the handle is curved vertically relative to the striking area. A bent handle displays the favorable elasticity property already by its geometric shape so that different materials or asymmetric cross sectional forms need not be used necessarily to this end. Moreover, from the direction of the arc, the player may tell at once which side of the racket is just used in the match.

The quality of an outwardly arcuate handle shape may be also achieved in that the arc is left out in a straight-lined handle. In both cases, the arc of the handle may be bridged by a traction element or a shock absorber to support the desired properties of the handle.

BRIEF DESCRIPTION OF THE DRAWINGS

With reference to the drawings, some embodiments of the invention will be explained hereinafter in more detail:

FIG. 1 is a perspective view of the tennis racket comprising a handle made of materials of a distinctive elasticity.

FIG. 2 is a cross section of an asymmetric handle,

FIG. 3 is a side view of an embodiment having a bent handle and a traction element bridging the arc, and FIG. 4 is an embodiment in which the arc is omitted in a straight-shaped handle.

DETAILED DESCRIPTION OF THE DRAWINGS

The tennis racket 1 shown in FIG. 1 has a substantially octagonal handle grip portion 2 to improve the grip portion adhesiveness, the subsequent handle portion 3*a* being square for transmitting the movements imparted by the player to the handle 2 to a substantially oval head 4 provided with crossing and interlacing strings 5. At its end facing the head, the handle 3*a* is flared Y-wise in the striking area plane so that its contour is adapted tangentially to the oval outer contour of head 4. The strings 5 of the head 4 form a double-sided striking area 6 being substantially plane in the space enclosed by head 4.

Via the strings 5, the head 4 and the handle 3*a*, the shock-type stress caused by the impact of the tennis ball is transmitted by the striking area 6 to the handle grip portion 2. The handle portion 3*a* also serves for attenuating said forces and moments.

FIG. 1 shows a racket 1 having a handle 3*a* cut open longitudinally and consisting of three interconnected material layers 9,10,11 of distinctive elasticity properties which layers are superposed in longitudinal direction of the striking area plane. It is also possible to use two materials only.

The striking properties of the tennis racket are dictated by the geometric arrangement and by the elastic properties as well as by the proportions of the used materials 9,10,11. Thus, as compared to material 10 or 10,11, material 9 may form only a thin marginal layer.

Preferably, the materials used are wood, plastics or metal as well as combinations and laminates thereof, the meaning of different materials also includes laminates of the same materials but of different thicknesses.

A different elastic behaviour of the handle 3*b* may be also realised by its asymmetric or semisymmetric cross sectional shape such as illustrated in FIG. 2, which may be still supported by using different materials 9,10,11 in the cross sectional direction.

FIG. 3 shows a side view of a tennis racket 1 to illustrate that the elastic properties may be obtained already by the shape of the handle 3*c* by designing it as an arc 7 which may be bridged additionally by a traction element 8 which may be a filamentary or band shaped flat structure preferably of a high tensile strength.

FIG. 4 shows another embodiment omitting the arc 12 in the straight-shaped handle 3*d*. Again, said arc 12 may be bridged by a traction element or by a shock absorber.

The constructional features of the embodiments according to FIGS. 1 to 4 may be optionally interchanged or combined to obtain the desired elastic properties of the tennis racket.

What is claimed is:

1. A tennis racket comprising a hand grip portion, a head carrying a plurality of strings which form a bilateral striking area, and an elongated handle portion extending between said hand grip portion and said head, said handle portion alone having a cross-sectional shape that is asymmetrical about a line extending perpendicular to the longitudinal axis of the racket and lying in a plane parallel to the plane formed by the striking area and composed of a plurality of superposed material layers, each with distinctive, differing elastic properties, said layers being superposed in the longitudinal direction of the striking area plane with each layer extending across a width of the handle portion, the combination of said asymmetrical shape and said material of different elastic properties on one side of the racket producing striking properties on that side which are different from the striking properties produced by the combination of said asymmetrical shape and said materials of different elastic properties on the opposite side of the racket.

* * * * *